US005320256A

United States Patent [19]

Wood

[11] Patent Number: 5,320,256

[45] Date of Patent: Jun. 14, 1994

[54] PRODUCT DELIVERY SYSTEM FOR DELIVERING STERILE LIQUID PRODUCT

[75] Inventor: Robert Wood, Garden Grove, Calif.

[73] Assignee: Allergan, Inc., Irvine, Calif.

[21] Appl. No.: 919,092

[22] Filed: Jul. 23, 1992

[51] Int. Cl.[5] ..... B65D 37/00

[52] U.S. Cl. ..... 222/212; 222/215; 251/7

[58] Field of Search ..... 222/206, 209, 210, 212, 222/214, 215, 505, 511, 517, 529; 251/7, 9

[56] References Cited

U.S. PATENT DOCUMENTS

| | | | |
|---|---|---|---|
| 600,552 | 3/1898 | Parker | 222/212 X |
| 617,495 | 1/1899 | Reimann | 222/214 X |
| 2,629,516 | 2/1953 | Badham | 222/214 X |
| 2,738,107 | 3/1956 | Graham . | |
| 2,899,110 | 8/1959 | Parker | 222/215 |
| 2,969,064 | 1/1961 | Metz | 251/9 X |
| 3,172,577 | 3/1965 | Hartung . | |
| 3,176,691 | 4/1965 | Ericson . | |
| 3,390,821 | 7/1968 | Mullan | 222/212 |
| 3,506,163 | 4/1970 | Rauh et al. . | |
| 3,833,154 | 9/1974 | Markowitz . | |
| 4,114,640 | 9/1978 | Forman . | |
| 4,258,865 | 3/1981 | Vahl et al. | 222/214 X |
| 4,610,664 | 9/1986 | Harle . | |

*Primary Examiner*—Kevin P. Shaver

*Attorney, Agent, or Firm*—Poms, Smith, Lande & Rose

[57] ABSTRACT

A product delivery system for delivering sterile liquid product having a positive shut-off valve to prevent back flow of liquid and air into the system. The product delivery system comprises a compressible reservoir, a flexible delivery element extending from the reservoir, and a shut-off valve movable from a closed position to an opened position, the hollow interior of the delivery element being closed when the shut-off valve is in its closed position and open when the shut-off valve is in its open position to prevent the back flow of the delivered liquid product and air into the delivery element and reservoir to thereby maintain the sterility of the liquid product contained within the reservoir and the delivery element.

8 Claims, 4 Drawing Sheets

PRODUCT DELIVERY SYSTEM FOR DELIVERING STERILE LIQUID PRODUCT

FIELD OF THE INVENTION

The present invention relates in general to product delivery systems and more particularly to a product delivery system for dispensing a liquid, the delivery system having a positive shut-off valve.

BACKGROUND OF THE INVENTION

There are many applications in which an amount of a liquid solution is dispensed onto a specific area. These situations especially occur in the context of medical applications where sterile, non-preservative solutions are used and where the solution must be dispensed in discrete portions onto a specific area. These delivery systems usually consist of a storage or reservoir area and some form of delivery element. Often, as a solution is dispensed from the reservoir and through the delivery element some back flow of the solution may be returned into the storage reservoir. This back flow, having been exposed to the environment outside the storage reservoir, may contain particulate and/or bacterial contamination and thus creates a problem with sterile solutions, since the contaminates may be transmitted into the material stored in the storage reservoir. The sterility of the solution remaining in the storage reservoir may thus be jeopardized by this backflow of the solution returning to the solution remaining in the storage reservoir.

Product delivery systems for dispensing a liquid solution are well-known in the art. However, these product delivery systems have design characteristics that can be improved. For instance, some product delivery systems have openings which remain open to the atmosphere when not in use, thereby allowing particulate and/or bacterial contaminates to enter the solution remaining in storage. Further, some product delivery systems have valves that are not positive shut-off valves. These non-positive shut-off valves will allow low viscosity fluids to drip or discharge when at rest. Some other product delivery systems have storage reservoirs that preclude the product from being dispensed from the opening in the reservoir when an air bubble remains in the opening to the delivery tube.

Some other product delivery systems have shut-off valves that do not form a tight seal in a discharge tube. These shut-off valves may consist of two male parts that only pinch the delivery tube. Further, some product delivery systems must be operated with two hands of the user. Other product delivery systems further do not provide a constant pressure on the storage reservoir to provide a constant flow of product. Finally, some product delivery systems do not deliver a measured amount of product.

It will be appreciated from the foregoing that there is a definite need for an improved product delivery system. The present invention fulfills these needs.

SUMMARY OF THE INVENTION

A principal object of the present invention is to provide a product delivery system for delivering a liquid solution that prevents the back flow of the delivered solution into the solution remaining in storage in the product delivery system.

Another object of the present invention is to provide a product delivery system that has a storage reservoir that is not open to the atmosphere when the product delivery system is not in use.

A further object of the present invention is to provide a product delivery system that will not drip or discharge low viscosity fluids when the shut-off valve is closed.

Another object of the present invention is to provide a product delivery system that can be operated with one hand by the user.

A further object of the present invention is to provide a product delivery system having a positive shut-off valve having a male portion and a female portion to provide a folding seal in a discharge tube extending from a storage reservoir.

A further object of the present invention is to provide a product delivery system in which a constant pressure can be maintained on the solution to provide a constant amount of flow of product from the storage reservoir.

Yet a further object of the present invention is to provide a product delivery system that can deliver a measured amount of product.

Another object of the present invention is to provide a product delivery system which is inexpensive to manufacture and simple to assemble.

In accordance with the present invention, a product delivery system and method is provided that delivers a liquid solution while preventing any back flow of the solution into the stored solution remaining in the product delivery system, that has a positive shut-off valve to provide a folding seal in the discharge element extending from the storage reservoir, that has a storage reservoir that is not open to the atmosphere when not in use, that will not drip or discharge low viscosity fluids when the shut-off valve is closed, that can provide a constant flow of product, that can provide a measured flow of product, that can be operated with one hand by the user, and that is inexpensive and easy to assemble. The foregoing objects are achieved through a compressible reservoir, a flexible delivery element having a hollow interior, the delivery element extending from the reservoir, and a shut-off valve movable from a closed position to an open position.

In one preferred embodiment of the product delivery system, the compressible reservoir is a bellows reservoir. The inside of the bottom portion of the reservoir is preferably raised to minimize the amount of residual product remaining in the reservoir.

In another preferred embodiment of the present invention, the shut-off valve has a first portion abutting the delivery element and a second portion also abutting the delivery element. The first and second portions of the shut-off valve are preferably brought together when the shut-off valve is in its closed position to thereby engage and close the hollow interior of the delivery element between the first and second portions of the valve.

In yet another preferred embodiment of the present invention, the first portion of the shut-off valve comprises a male portion while the second portion of the valve preferably comprises a female portion. The male and female portions of the shut-off valve provide a fold seal in the delivery tube. When not in use, the product delivery system preferably stores the liquid product within the bellows reservoir. The liquid stored within the reservoir is closed off from the atmosphere by the shut-off valve. The fold seal of the shut-off valve provides a better seal for preventing the back flow of the fluid in the delivery element back into the storage reservoir, closes the bellows reservoir to the atmosphere when not in use, prevents the dripping or discharge of low viscosity fluids and allows the system to be operated with one hand by the user.

The first and second portions of the shut-off valve preferably include trigger handles extending from the male and female portions of the valve. The trigger handles are formed such that they may be depressed by the index finger and middle finger of the user. The first and second portions of the shut-off valve are preferably maintained in their closed position by an elastic element and are preferably rotatably mounted to a pivot means.

The delivery element, which extends from the bellows reservoir, preferably comprises a flexible tube. The delivery element further preferably includes a nozzle at its open end for delivering the product from the bellows reservoir. The nozzle may further include a check valve.

To deliver a product from the bellows reservoir, the user preferably presses his thumb upwardly against the bottom of the bellows reservoir while depressing the trigger handles of the male and female portions of the valve. The male and female portions of the valve are preferably rotated about their pivot means from the closed position of the shut-off valve to the opened position of the shut-off valve and thus the hollow interior of the delivery element is opened. The pressure on the product solution within the bellows reservoir provided by the compression of the bellows by the thumb of the user forces the product solution from the bellows reservoir, through the delivery element and out the nozzle of the delivery element.

In another preferred embodiment of the present invention, a compression spring is mounted to the bottom of the bellows reservoir for compressing the reservoir when the valve is open. The user depresses the trigger handles to open the valve and allow the force provided by the compression spring to compress the bellows reservoir, thereby forcing a constant flow of the product solution through the delivery tube and out the delivery nozzle.

In another preferred embodiment of the present invention, the first and second portions of the shut-off valve comprise crush bars to provide a seal in the delivery element when the shut-off valve is in its closed position. The first and second portions of the shut-off valve are oriented in a vertical direction with the moveable first portion of the shut-off valve being in a position below the fixed second portion of the shut-off valve. The first portion of the shut-off valve preferably includes trigger handles extending from both sides of the first portion of the shut-off valve. In this particular embodiment of the present invention, the shut-off valve is maintained in its closed position by a spring element or elastic element that forces the first portion of the shut-off valve to close the hollow interior of the delivery element against the fixed second portion of the shut-off valve.

In yet a further preferred embodiment of the present invention, a product delivery system that delivers a measured amount of flow of the liquid product is provided. This embodiment of the present invention is known as a cam controlled linear parastolic dispenser. In this preferred embodiment of the present invention, the liquid solution flows through a flexible delivery element. A pump element that is preferably moveable along the delivery element abuts the delivery element to provide a positive pressure on the delivery element. The pump element preferably comprises a pair of wheels being moveable from a position where both wheels abut the delivery element to a position where only one wheel abuts the delivery element. The pump element further preferably includes a moveable cam connected to the pump element.

In this particular preferred embodiment of the present invention, a shut-off valve moveable from a closed position to an opened position is also provided. The shut-off valve preferably comprises a moveable first portion abutting the delivery element and a fixed second portion also abutting the delivery element. The first and second portions of the shut-off valve are maintained in their closed position by the upward force of a spring element mounted to the first portion of the shut-off valve. The first portion of the shut-off valve preferably includes a fixed cam guide mounted above a moveable cam guide.

In this particular embodiment of the present invention, measured amounts of product are delivered by moving the pump element with the pair of wheels abutting the delivery element along the length of the delivery element to provide a positive pressure on the product within the delivery element. The shut-off valve is preferably moved to its opened position by the downward force on the first portion of the shut-off valve by the moveable cam of the pump element engaging the moveable cam guide of the first portion of the shut-off valve to provide a measured amount of liquid product.

Accordingly, the product delivery system of the present invention preferably embodies a shut-off valve having either a male and female portion or a crush bar configuration to provide a shut-off valve that prevents the back flow of liquid product into the storage reservoir or delivery tube, and thereby prevents the contamination of the sterile product located within the storage reservoir. Further, when the product delivery system is not in use, the shut-off valve is maintained in a closed position thereby preventing the product within the storage from being open to the atmosphere. This shut-off valve also prevents the dripping or discharge of low viscosity fluid product when the shut-off valve is closed. The product delivery system of the present invention may be operated with one hand by the user. In another preferred embodiment of the present invention, a constant flow of product from the product delivery system is provided. In yet another preferred embodiment of the present invention, a product delivery system is provided that delivers a measured amount of product. Other objects, features, and advantages of the invention will become apparent from a consideration of the following detailed description and from the accompanying drawings.

DETAILED DESCRIPTION OF THE PREFERRED EMBODIMENTS

The present invention is embodied in a product delivery system 10 and method for delivering a liquid product from a reservoir without back flow of the product into the sterile product remaining in the reservoir, that contains liquid product which is not open to the atmosphere when the product delivery system is not in use, that will not drip or discharge low viscosity liquid product when the shut-off valve is closed, that, in an alternative embodiment, will deliver a constant flow of product, that, in another alternative embodiment, will deliver a measured amount of product, that can be operated with one hand by the user and that is inexpensive to manufacture and simple to assemble. The product delivery system of the present invention is suited for delivery of any liquid solutions, particularly those in which the sterility of the liquid product is essential. The product delivery system of the present invention is particularly useful in medical applications for delivering sterile, non-preservative liquids for use on eyes, ears, nose, infections, wound and surgical irrigation. Further, the product delivery system of the present invention is useful for other applications involving the use of liquid solutions, such as, the use of food coloring and flavoring, over-the-counter drug delivery where controlled doses of over the counter medications are needed, and in mechanical applications such as the delivery of glue and lubricants.

Figure 1:
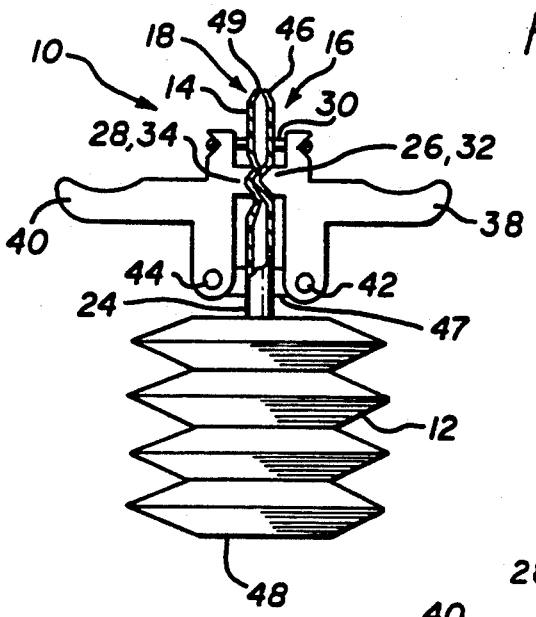
FIG. 1 is a front view of the product delivery system with which one embodiment of the present invention can be used.
Figure 2:
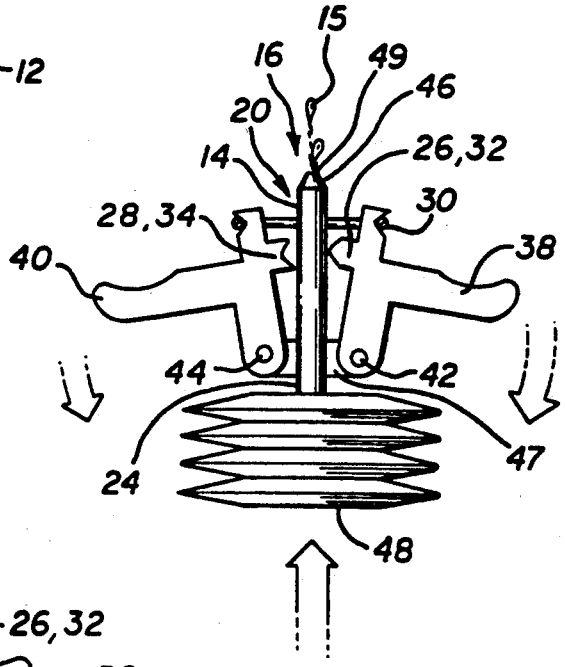
FIG. 2 is a front view of the product delivery system of FIG. 1 showing the delivery of the product with the arrows indicating the direction of force to be applied by the fingers of the user.

In the particular embodiments shown in the drawings and herein described, the product delivery system 10 comprises a storage reservoir 12, a flexible delivery element 14, and a shut-off valve 16 moveable from a closed position 18 (FIG. 1) to an opened position 20 (FIG. 2). The storage reservoir 12 is preferably compressible and is preferably a bellows reservoir. The reservoir 12 provides a storage area for the liquid product and can maintain the product in a sterile environment. The reservoir 12 is of a size so that it may fit within the palm of the hand of the user so that the user may compress the reservoir 12 by putting pressure on the bottom of the reservoir with the user's thumb. The reservoir is preferably made of a plastic which is inert to the liquid solutions used in medical, food and/or mechanical applications. The inside of the bottom portion of the reservoir 12 is preferably raised 22 (FIG. 4) to minimize the amount of residual product remaining in the reservoir 12 when a substantial amount of the liquid product has been delivered. Thus, the full measured amount of liquid product within the reservoir 12 is delivered and does not remain within the reservoir 12 when it cannot be removed any further by compressing the reservoir 12.

In one preferred embodiment of the present invention, the shut-off valve 16 is movable from a closed position 18 (FIG. 1) to an opened position 20 (FIG. 2). The shut-off valve 16 preferably has a first portion 26 abutting the delivery element 14 and a second portion 28 also abutting the delivery element 14. The first and second portions 26, 28 of the shut-off valve 16 are brought together when the shut-off valve 16 is in its closed position 18 by the force provided by an elastic element 30 mounted to the first and second portions 26, 28 of the shut-off valve 16. Thus, the shut-off valve 16 engages and closes the hollow interior of the delivery element 14 in a clamp-like manner between the first and second portions 26 and 28, respectively, of the shut-off valve 16 when the shut-off valve 16 is in its closed position 18.

Each of the first and second portions, 26 and 28, respectively, of the shut-off valve 16 preferably further include an extending trigger handle, 38 and 40, respectively. (FIGS. 1 and 2). Each trigger handle, 38 and 40, is shaped so that the index finger and/or the middle finger of the user can be placed on the top of the trigger handle to depress the trigger handles 38, 40. The first and second portions, 26 and 28, respectively, of the shut-off valve 16 are preferably rotatably mounted to the reservoir 12 by a pair of pivot means, 42 and 44, respectively, on each portion of the shut-off valve 16, the pivots being connected to a support base 47. The pivot means, 42 and 44, provide the rotation so that the first and second portions, 26 and 28, respectively, of the shut-off valve 16 can rotate about the pivot means, 42 and 44, so that the shut-off valve 16 may be moved from an opened to a closed position, 18 and 20, respectively.

A flexible delivery element 14 having a hollow interior extends from an opening 24 at the top of the reservoir 12. (FIGS. 1 and 2). The delivery element 14 is preferably a flexible tube having a hollow interior that is closed by the first and second portions, 26 and 28, respectively, of the shut-off valve 16 when the shut-off valve 16 is in its closed position 18. When the hollow interior of the delivery element 14 is closed, back flow of solution into the reservoir 12 is prevented. Thus, if the solution in the delivery element 14 becomes contaminated by a particulate or a bacteria, that contaminated solution will be prevented from entering the sterile solution remaining in the reservoir. Further, the seal in the delivery element 14 prevents the solution remaining in the reservoir from being open to the atmosphere and prevents dripping or discharge of low viscosity fluids when the shut-off valve 16 is closed. A nozzle 46 is preferably provided at the end of the delivery element 14 to provide better control of the flow of the product solution out of the delivery element 14. The nozzle 46 may further include a check valve within the nozzle 46.

In another preferred embodiment of the present invention, the first portion 26 of the shut-off valve 16 is a male portion 32 and the second portion 28 of the shut-off valve 16 is a female portion 34. (FIGS. 1 and 2). The male and female portions 32, 34, respectively of the shut-off valve create a fold seal 36 in the delivery element 14 when the shut-off valve is in its closed position 18. This fold seal 36 will further aid in preventing the back flow of contaminated liquid product into the reservoir 12. Further, the fold seal 36 formed by the shut-off valve 16 provides a closure to the atmosphere for the fluid remaining in the reservoir 12 when the product delivery system 10 is not in use and further prevents dripping or discharge of low viscosity fluids when the shut-off valve 16 is in its closed position 20 (FIG. 2).

The product delivery system 10 of this preferred embodiment of the present invention is operated by placing the product delivery system 10 in the palm of the hand of the user with the user's thumb being placed on the bottom portion 48 of the reservoir 12 and the user's index and middle fingers being placed on the trigger handles, 38 and 40, respectively. (FIGS. 1 and 2). The user then presses upwardly with their thumb on the bottom portion 48 of the reservoir 12 while depressing the trigger handles, 38 and 40, with their index and middle fingers. The pressure on the product liquid 15 within the reservoir 12 exerted by the thumb of the user forces the product liquid upwardly through the opening 24 of the reservoir 12. (See arrows in FIG. 2).

The force of the depression of the trigger handles, 38 and 40, by the index and middle finger of the user causes the first and second portions, 26 and 28, respectively, of the shut-off valve 16 to rotate about the pivot means, 42 and 44, respectively. (FIGS. 1 and 2). This pivoting causes the first and second portions, 26 and 28, respectively, of the shut-off valve 16 to move apart against the force of the elastic element 30, thereby opening the hollow interior of the delivery element 14 and allowing the product liquid to be forced through the delivery element 14 and out the opening 49 of the nozzle 46.

The flow of the liquid product from the delivery nozzle is stopped by releasing the pressure on the bottom portion 48 of the reservoir 12 by the user's thumb and by releasing the force on the trigger handles, 38 and 40, by the user's index and middle fingers. The release of this pressure causes the elastic element 30 to again force the first and second portions, 26 and 28, respectively, of the shut-off valve 16 to rotate on the pivot means, 42 and 44, toward each other and again clamp the hollow interior of the delivery element 14 shut between the first and second portions 26, 28 of the shut-off valve 16.

Figure 3:
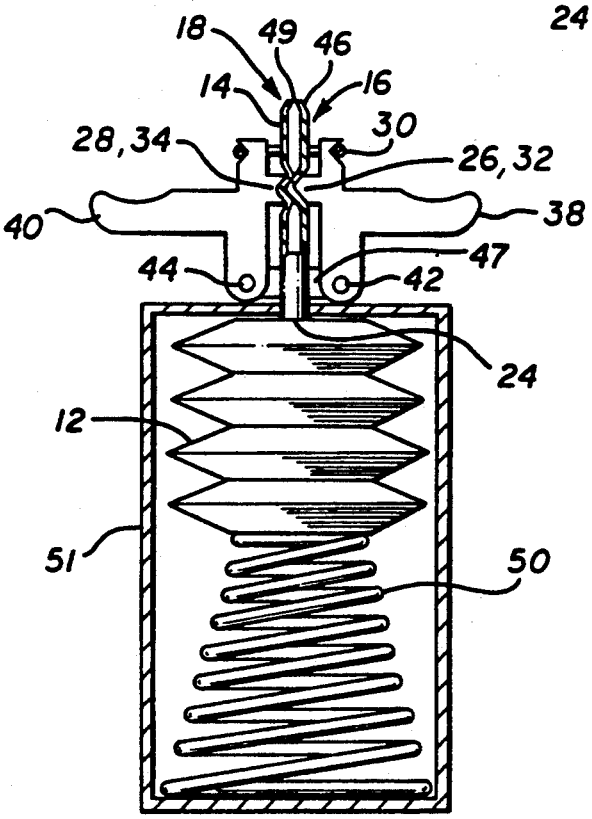
FIG. 3 is a front and partial cross-sectional view of the product delivery system with which one embodiment of the present invention can be used showing a compression spring.

In another preferred embodiment of the present invention, wherein like numerals refer to like parts of the embodiment of FIGS. i and 2, the reservoir 12 is contained within an envelope 51 (FIG. 3) and a compression spring 50 may be provided within the envelope to exert a compressive force on the reservoir 12. Thus, the user does not have to apply pressure to the bottom portion 48 of the reservoir 12 with the user's thumb and a constant flow of liquid product is provided. In this preferred embodiment of the present invention, the product is delivered by the user depressing the trigger handles 38 and 40, with their index and middle finger. The force provided by the compression spring 50 will cause the liquid product within the reservoir 12 to be delivered from the delivery element 14.

Figure 5:
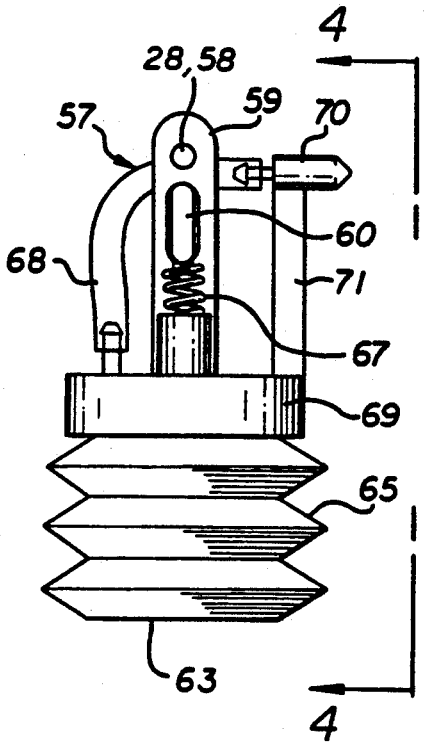
FIG. 5 is a side view of the embodiment of the present invention shown in FIG. 4 taken along the line 4—4 of FIG. 4.
Figure 4:
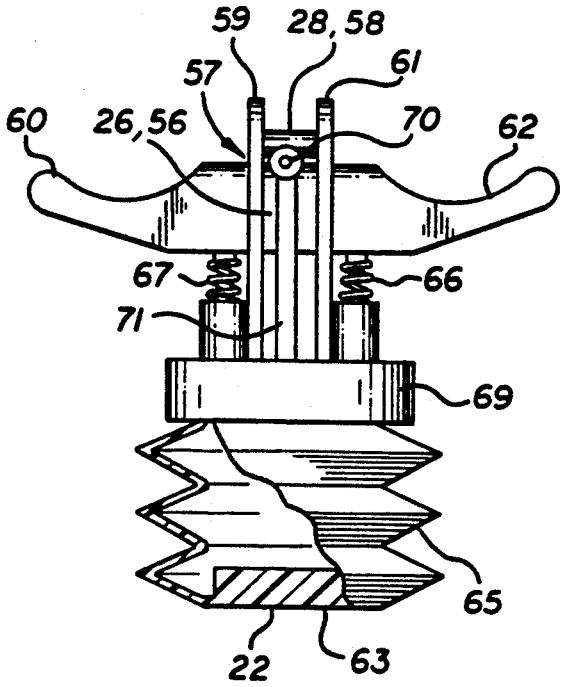
FIG. 4 is a front and partial cross-sectional view with which one embodiment of the present invention can be used.
Figure 6:
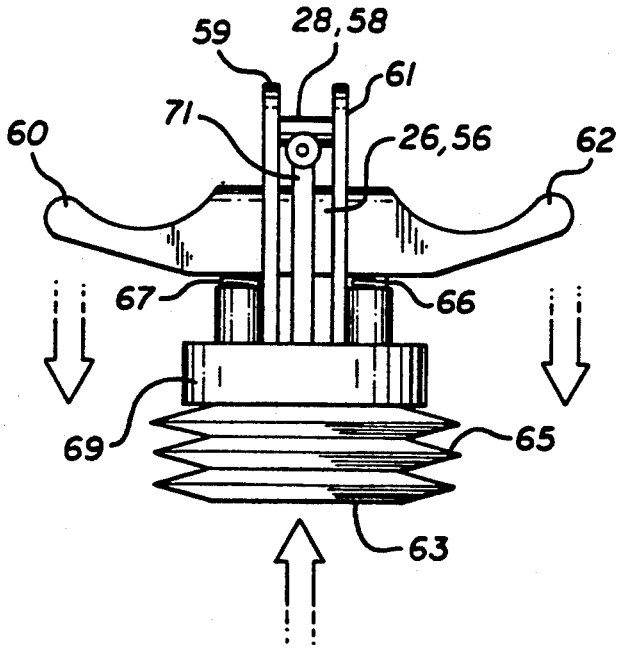
FIG. 6 is a front view of the embodiment of the present invention shown in FIG. 4 showing the delivery of the product with the arrows showing the direction of force to be applied by the fingers of the user.
Figure 6A:
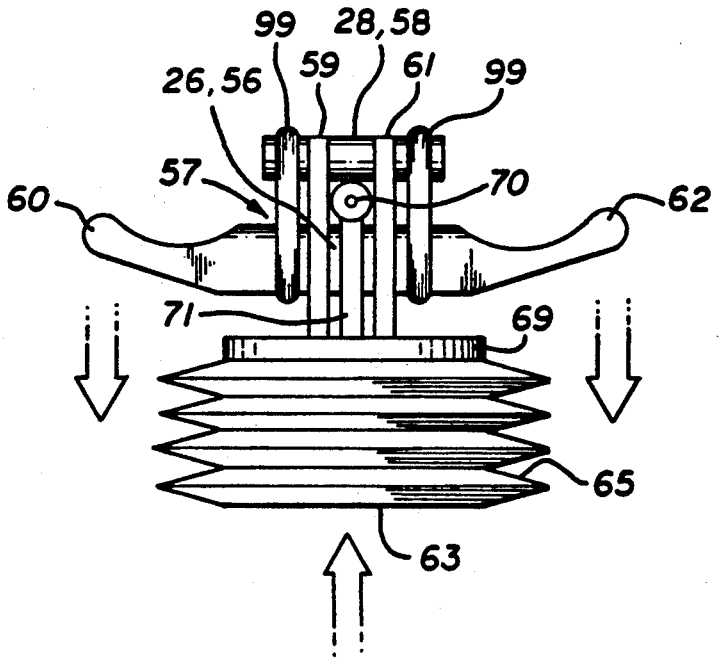
FIG. 6A is a front view of the embodiment of the present invention shown in FIG. 4 including the pair of elastic elements with the arrows showing the direction of force to be applied by the fingers of the user.
Figure 6B:
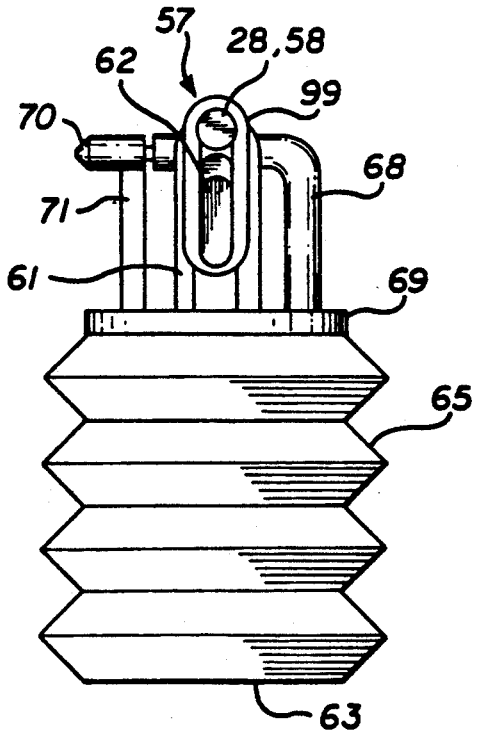
FIG. 6B is a side view of the embodiment of the present invention shown in FIG. 6A.

In yet another preferred embodiment of the present invention, shown in FIGS. 4 to 6, the first and second portions (comparable to portions 26 and 28, respectively, in the embodiment of FIGS. 1 and 2) of the shut-off valve 57 comprise crush bars, 56 and 58, respectively, to provide a seal in the delivery element when the shut-off valve 57 is in its closed position. The crush bars 56, 58 of the shut-off valve 57 are oriented in a vertical direction with the fixed second portion or crush bar 58 of the shut-off valve 57 being in a position above the moveable first portion 56 of the shut-off valve 57. The crush bar 56 of the shut-off valve 57 preferably includes trigger handles, 60 and 62, extending from both sides of the first portion 56 of the shut-off valve 57. The first crush bar 56 of the shut-off valve 57 comprises the center portion between the trigger handles, 60 and 62. The first crush bar 56 of the shut-off valve 57 comprises the center portion between the trigger handles, 60 and 62. In this particular embodiment of the present invention, the shut-off valve 57 is maintained in its closed position 64 by a pair of spring elements 66 and 67 that forces the first crush bar 56 of the shut-off valve to close the hollow interior of the delivery element 68 (see FIGS. 4 and 5) against the fixed second portion 58 of the shut-off valve 57. In another preferred embodiment of the present invention shown in FIGS. 6A and 6B, the shut-off valve 57 may also be maintained in its closed position 64 by a pair of elastic elements 99 or elastic rings 99 that are stretched between the first crush bar 56 and the second crush bar 58 to close the hollow interior of the delivery element 68 between the first crush bar 56 and the fixed second crush bar 58 of the shut-off valve 57. The delivery element 68 is preferably a flexible, resilient tube. The pair of spring elements 66 and 67 are mounted on a support base 69. A nozzle support 71 extends from the support base 69 to support the nozzle 70 mounted to the end of the delivery element 68. The first and second portions, 56 and 58, respectively, of the shut-off valve 57 are maintained in their positions on the delivery element 68 by a pair of shut-off valve guides 59 and 61.

In this preferred embodiment of the present invention, the liquid product is delivered when the user presses their thumb against the bottom 63 of the reservoir 65 while depressing the trigger handles, 60 and 62, with their index and middle finger, thereby causing the first portion 56 of the shut-off valve 57 to move against the force of the pair of spring elements, 66 and 67, causing the hollow interior of the delivery element 68 to open and force the liquid product through the delivery element and out the nozzle 70. (See arrows in FIG. 6). The shut-off valve 57 is moved to its closed position by the release of the force on the trigger handles, 60 and 62, by the release of the pressure of the index and middle fingers of the user. The force of the pair of spring elements, 66 and 67, against the first portion of the shut-off valve causes the first portion 56 of the shut-off valve 57 to move upwardly and return to its closed position where the hollow interior of the delivery element is closed.

Figure 7:
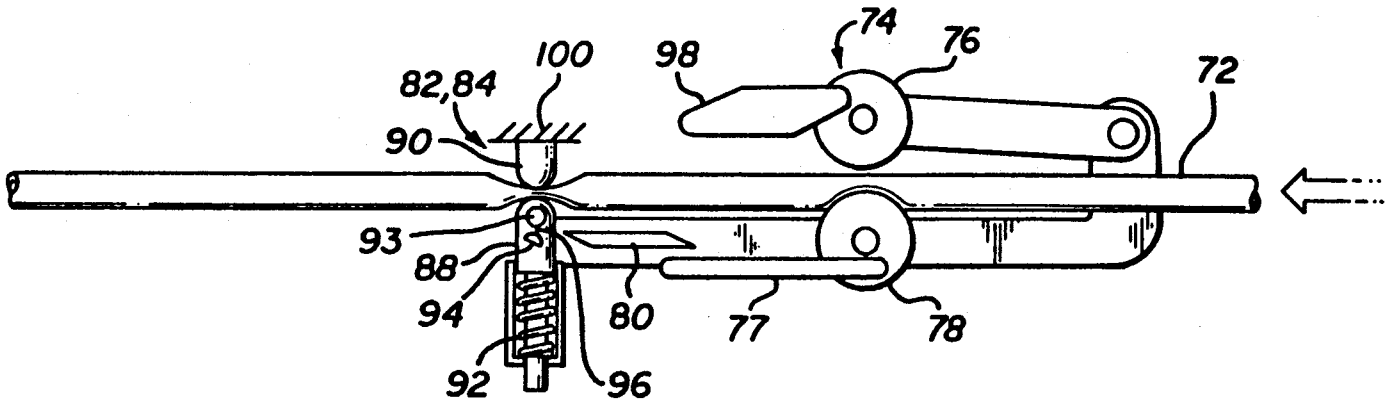
FIG. 7 is a side partial cross-sectional view of the product delivery system with which one embodiment of the present invention can be used with the arrow indicating the direction of flow of the product within the delivery tube.
Figure 8:
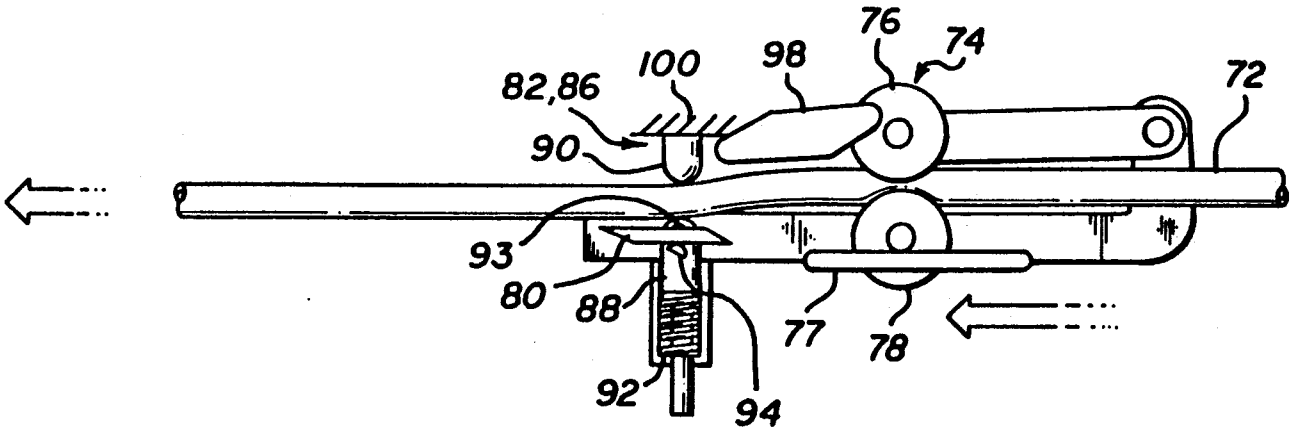
FIG. 8 is a side partial cross-sectional view of the embodiment of the present invention shown in FIG. 7 showing the delivery of the product with the arrow indicating the direction of movement of the support frame.

In yet another preferred embodiment of the present invention, a product delivery system that delivers a measured amount of flow of the liquid product is provided. (FIGS. 7 and 8). This embodiment of the present invention is known as a cam controlled linear parastolic dispenser. In this preferred embodiment of the present invention, the liquid solution flows through a flexible delivery element 72. The delivery element 72 preferably comprises a flexible, resilient delivery tube. A pump element 74 that is preferably moveable along the delivery element 72 abuts the delivery element 72 to provide a positive pressure on the delivery element 72. The pump element 74 preferably comprises a pair of wheels, 76 and 78, the wheels being moveable from a position where both wheels 76, 78 abut the delivery element 72 (FIG. 7) to a position where only one wheel abuts the delivery element 72. (FIG. 8). The pump element 74 further preferably includes a moveable cam 80 connected to the pump element.

In this particular preferred embodiment of the present invention, a shut-off valve 82 moveable from a closed position 84 to an opened position 86 (FIG. 8) is also provided. The shut-off valve 82 preferably comprises a moveable first portion 88 abutting the delivery element 72 and a fixed second portion 90 also abutting the delivery element 72. The first and second portions, 88 and 90, respectively, of the shut-off valve 82 are maintained in their closed position 84 by the upward force of a spring element 92 mounted to the first portion 88 of the shut-off valve 82. When the shut-off valve 82 is in its closed position 84, the first and second portions, 88 and 90, respectively, of the shut-off valve 82 preferably engage and close the hollow interior of the delivery element 72. The first portion 88 of the shut-off valve 82 preferably includes a fixed cam guide 93 mounted above a moveable cam guide 94.

Measured amounts of product are preferably delivered by this particular embodiment of the present invention by moving the pump element 74 with the pair of wheels, 76 and 78, abutting the delivery element 74 along the pump element platform 77 and along the length of the delivery element to provide a positive pressure on the product within the delivery element. (See arrow in FIG. 8). The moveable cam 80 mounted to the pump element 74 then preferably engages the fixed cam guide 92 and the moveable cam guide 94 mounted to the first portion 88 of the shut-off valve 82 in the space 96 between the fixed and moveable cam guides 93, 94, thereby causing the moveable cam guide 94 to force the first portion 88 of the shut-off valve 82 downwardly against the force of the spring element 92. The downward motion of the first portion 88 of the shut-off valve 82 moves the shut-off valve to its opened position 86 and thereby opens the hollow interior of the delivery element 74. The positive pressure on the delivery element 72 stops as the movement of the pump element 74 is stopped when the pump element cam 98 abuts the fixed stop element 100. The positive pressure on the delivery element 72 may also be stopped by removing one of the wheels 76 of the pump element 74 from its position where it abuts the delivery element 72 as shown in FIG. 7. The delivery of the product through the delivery element 72 stops when the positive pressure on the delivery element stops. Thus, since the diameter of the delivery element 72 is known and since the distance that the pump element 74 travels along the delivery element 72 is known, the amount of product delivered can be a specified measured amount. Different measured amounts may be provided by changing the diameter of the delivery element 72 and/or changing the distance that the pump element 74 exerts positive pressure on the delivery element.

While a particular form of the invention has been illustrated and described, it will be apparent that various modifications can be made without departing from the scope of the invention. For instance, the first and second portions of the shut-off valve may comprise any number of combinations of male and female portions which provide an adequate seal in the delivery tube to maintain the sterility of the liquid product within the reservoir. Further, the reservoir may be any compressible type of reservoir maintaining the sterility of the product and for delivering product. Further, the trigger handles and reservoir may be of such a size that they are too large to fit in the hand of the user and methods other than the use of the hand would be necessary to open the valve and force the liquid from the reservoir through the delivery tube. Accordingly, it is not intended that the invention be limited by the specific embodiment disclosed in the drawings in and described in detail hereinabove.

I claim:

1. A product delivery system for delivering sterile liquid product, comprising:

a compressible reservoir for storing the sterile liquid product;

a flexible delivery element extending from the reservoir, the delivery element having a hollow interior for delivering and storing the sterile liquid product;

a shut-off valve moveable from a closed position to an opened position, the shut-off valve having a first portion being moveable and abutting the delivery element and a second portion being fixed in place and abutting the delivery element, wherein when the first portion of the shut-off valve is moved apart from the second portion of the shut-off valve, the shut-off valve being in its opened position, and the reservoir is compressed, sterile liquid product is delivered from the reservoir and through the delivery element and wherein when the first portion of the shut-off valve is brought together with the second portion of the shut-off valve, the shut-off valve being in its closed position, the first and second portions of the shut-off valve engage and close the hollow interior of the delivery element between the first and second portions of the shut-off valve to prevent the back flow of the delivered liquid product and air into the delivery element to thereby maintain the sterility of the liquid product contained within the reservoir and the delivery element.

2. The product delivery system of claim 1, wherein the compressible reservoir is a bellows reservoir.

3. The product delivery system of claim 1, further including an elastic element mounted to the first and second portions of the shut-off valve for maintaining the shut-off valve in its closed position.

4. The product delivery system of claim 1, wherein the first portion of the shut-off valve is a crush bar and the second portion of the shut-off valve is a crush bar.

5. The product delivery system of claim 4, further including a pair of trigger handles extending from the first portion of the shut-off valve.

6. The product delivery system of claim 1, further including a nozzle at the end of the delivery element.

7. The product delivery system of claim 1, wherein the inside of the bottom portion of the reservoir is raised to minimize the amount of residual product remaining in the reservoir.

8. The product delivery system of claim 1, wherein the delivery element is a tube.

* * * * *